United States Patent [19]

Fetzer et al.

[11] Patent Number: 4,905,917

[45] Date of Patent: Mar. 6, 1990

[54] ROLL MILL AND METHOD FOR FEEDING PARTICULATE MATERIAL

[75] Inventors: Wilhelm Fetzer, Niederuzwil; Edgar Ruegger, Arnegg, both of Switzerland

[73] Assignee: Gebrueder Buehler AG, Uzwil, Switzerland

[21] Appl. No.: 132,218

[22] Filed: Dec. 14, 1987

[30] Foreign Application Priority Data

Dec. 17, 1986 [DE] Fed. Rep. of Germany ..... 3642974

[51] Int. Cl.[4] ..... B02C 4/02

[52] U.S. Cl. ..... 241/30; 241/101 B; 241/226

[58] Field of Search ..... 241/225, 30, 226, 98, 241/135, 158, 159, 224, 243, 101 B

[56] References Cited

U.S. PATENT DOCUMENTS

| | | | |
|---|---|---|---|
| 261,337 | 7/1882 | Gray | 241/225 |
| 813,320 | 2/1906 | Neumann | 241/226 |
| 1,050,183 | 1/1913 | Wall | 241/226 |
| 1,810,773 | 6/1931 | Linders | 241/225 X |
| 2,925,226 | 2/1960 | Pratique | 241/225 |
| 3,282,199 | 11/1966 | Mason et al. . | |
| 4,193,555 | 3/1980 | Ruegger . | |

FOREIGN PATENT DOCUMENTS 2900922 4/1983 Fed. Rep. of Germany .

*Primary Examiner*—Mark Rosenbaum
*Attorney, Agent, or Firm*—Martin A. Farber

[57] ABSTRACT

A roll mill, particularly a flaking mill, for milling particulate material comprises at least two rollers, especially a stationary roller and a movable one, pressed against each other by means of a pressure exerting device. Product is supplied in a width greater than the axial width of the rollers and their nip. Channels are arranged on both lateral ends of the rollers and collect the material fed in excess of the axial length of the rollers, said channels being preferably open towards the rollers, especially over their whole length. Each of said channels discharges onto a guide surface situated above the nip of the rollers and discharges in turn all the material from the channels into the nip above the upper gripping zone of the nip.

42 Claims, 7 Drawing Sheets

ROLL MILL AND METHOD FOR FEEDING PARTICULATE MATERIAL

FIELD OF THE INVENTION

The invention relates to a roll mill, and in particular to a flaking mill, for milling particulate material, which comprises a pair of rollers pressed against each other by a biasing unit and forming a nip between one another to grip particles to be milled between said surfaces. Usually, there are means (e.g. an abutment device) which ensure a certain minimum gap between the rollers within the region of the nip, but this is not always the case. Normally, one roller is stationary, so that only the other one, which is movable, is pressed by the unit against the stationary one. In any case, however, the particles are gripped in an upper zone of the nip and are squeezed immediately subsequently sequently in a lower zone below the upper (gripping) zone, i.e. in an intermediate nip zone, when the rollers are rotating about their respective axes of rotation. There are feeding means for feeding the particles to be milled to the rollers over a feeding width exceeding the axial length of the rollers. Furthermore, the invention is concerned with a new method for feeding particulate material to a pair of rollers of a roll mill.

BACKGROUND OF THE INVENTION

The quality of material treated by roll mills, e.g. of seeds, such as grains or soybeans, depends upon uniform working conditions along the entire working surface or working line of the rollers pressed against one another. Especially in the case where there are no means to ensure a predetermined minimum gap between the rollers, damage might easily occur, if the rollers are pressed one against the other with elevated pressure without having particles between them. Mostly, flaking rollers are given a slight difference in rotational speed to "polish up" the flakes, so that lacking material between them, they would rub themselves and would damage their peripheral surfaces. But such damage or differences in wear may also occur due to a non-uniform supply of material to be milled. The worse the supply of material is in the lateral end regions of the rollers, the more they will be subjected to different wear in these end regions, as compared with the center regions. Such difference in wear is the reason, why it will become necessary too soon to regrind the rollers, this treatment causing long periods of disuse, because machining of the surfaces has to be done with particulaly high precision and, thus, with corresponding expenditures.

It has already been proposed (U.S. Pat. No. 3,282,199) to provide collecting structures at the lateral end regions of a roll mill, below the nip of the rollers, the collecting structure sealing the rollers by a wedge surface. Through tubings conveying the particulate material pneumatically, these collecting structures were connected to the feeder for refeeding the material to the rollers. Although it is possible to refeed the particulate material, which has emerged from the nip and is probably badly milled, with such a device, a relatively high energy consumption will result from the pneumatic conveyance and by refeeding through the feeder itself (which will be charged twice), on the one hand, whereas uniformity of wear and of feed is by no means ensured.

From German patent No. 29 00 922, a roll mill is known, the rollers of which having a reduced diameter in the lateral end regions. Collecting devices for material were provided on both ends, below the rollers, in order to refeed collected particles by a screw conveyor back into the feeder of the roll mill. Although the design with a reduced diameter of the roller ends may have a certain advantage, because it prevents a contact of the metallic peripheral surfaces in the critical end regions, the same disadvantages will occur as mentioned above.

U.S. Pat. No. 4,193,555 describes a roll mill, which is fed over a width slightly exceeding the length of the roller gap. On both sides of the gap, there are plate-like gap seals pressed against the flat front surfaces of the rollers. There is a small recess or groove provided in each of the gap seals for guiding the material better into the gap. These recesses extend just to the gap itself and may, thus, cause jamming of the material before the gap, because the (smaller) gap could not receive the particles. Accordingly, the recesses took more the shape of grooves in a relatively thin plate. Moreover, in practice, it was necessary, when separating the rollers from one another, to displace one end of one roller from the end of the other one, whereas the other roller has to be separated on its other end, so that their axes became inclined relatively to the normal operating position.

SUMMARY OF THE INVENTION

It is an object of the present invention to provide a roll mill and a method, in which the supply of material and back-guiding of the material are tuned in such a manner that a uniform milling effect for the particulate material and a uniform wear of the rollers will result.

This object is attained by providing channels for collecting the material fed in excess on the sides and by guiding this material to a level above the upper zone of the nip of the rollers, where it is dropped into the nip. By providing channels, it will be possible to uniformly feed material to the nip, because one can feed the material over a greater width than formerly, so that essentially the whole lateral feeding zone (where the supply is always somewhat non-uniform and poorer) can be collected by the channels. By discharging the material above the upper zone of the nip, where the material is first contacted by the peripheral surfaces of the rollers, the material can effectively be fed back into the nip, avoiding jamming. Long term tests in practice have shown, that in this way a more uniform wear of the rollers could be achieved and any mutual rolling or self-grinding of the roller surfaces could safely be prevented.

Guidance of the material is improved, if the guide surfaces, guiding the particles from the channels to the nip, are inclined to the horizontal, preferably by 20° to 60°, particularly in the range of 30°. With the latter range, the guide surface is also easier to manufacture.

As will become apparent from the description, the guide surfaces may be made movable, i.e. rotatable, but by making the guide surfaces stationary irregular influences by vibrations or the like can be avoided in a simple way, whereby also manufacture and maintainance are made easier.

It is also favorable, if the guide surfaces are separated from the channels, thus providing more liberty in design, avoiding transfer of vibrations and simultaneously making maintainance and repair easier.

The guide surface can easily be kept free of vibrations from the rollers, if a guide wall is supported by a reinforcing plate.

It is preferred, if the channels extend from the rollers upwardly to the feeder so that the particulate material is safely guided.

As already mentioned above, it is an object of the invention to make the wear of the rollers more uniform over their length. A first thought in this direction, according to a preferred embodiment, encompasses the recognition that part of occurring non-uniformities of wear which occur is due to the fact that the particulate material dehomogenizes when filled into a hopper or box-type feeder, because finer particles take another way than coarser ones. Since, however, finer particles influence the wear in another way than coarser ones, it had been found most probable that this could be one reason for the problem.

Therefore, further according to the invention, it is proposed to install a mixing compartment within the feeder and to provide a mixer with freely ending arms within this compartment to ensure optimum mixing efficiency. The fact that the mixer is immediately located within the feeder, later makes dehomogenizing impossible.

BRIEF DESCRIPTION OF THE DRAWINGS

Further details will become apparent by the following description of embodiments schematically illustrated in the drawings.

DETAILED DESCRIPTION OF THE INVENTION

Figure 1:
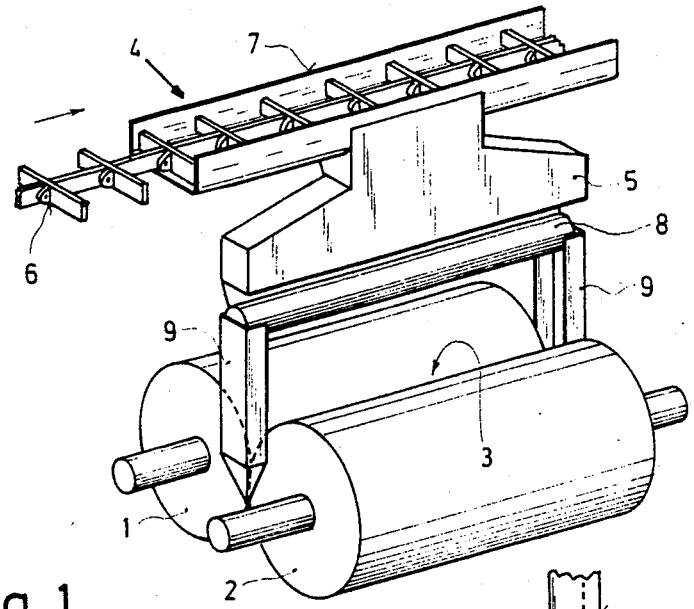
FIG. 1 illustrates a roll mill together with means for the supply of particulate material, including a box-type feeder, in a perspective view.

A roll mill according to FIG. 1 comprises two rollers 1 and 2, one which preferably being stationary, while the other one is parallely displaceable and is pressed by an arrangement known per se, generally including hydraulic means, against the stationary one. Both rollers 1, 2 form a nip 3 between each other, i.e. a region where the particles of the material are first gripped by the peripheral surfaces of the rollers 1, 2, and are then squeezed. Above the nip 3, there may be a conveyor 4 for the material followed by a box-type feeder 5 to which the material is transported through a conveyor chain 6 running within a trough 7. Of course, the arrangement of this conveyor is only an example, because any other arrangement and type of conveyor may also be used, for example by mounting a bin directly above the box-type feeder.

Within the box-type feeder, there is a mixing compartment with a mixer comprising freely ending arms, as will be described later with reference to FIGS. 10 to 13. Discharge from the box-type feeder is effected by means of a feed roll 8. As may clearly be seen from FIG. 1, the box-type feeder 5 as well as the feed roll 8 extend beyond the axial length of the rollers 1, 2 and their nip 3. As is preferred, at both ends of the feed roll 8 there are guide channels 9 which are substantially U-shaped, as best seen from FIGS. 2 and 4, as to open towards the rollers 1, 2. Each of these guidances discharge above the upper region of the nip 3, where the particles are first gripped, by means of a guide surface into the region between the rollers 1 and 2. Such a roll mill is particularly adapted as a squeezing or flaking mill in which the rollers are pressed together thereby having a slight difference in speed to "polish" the surface of the flakes which, in most cases, are produced to enable a solvent to act in a uniform way upon the material, as in the case of oil seeds.

Figure 2:
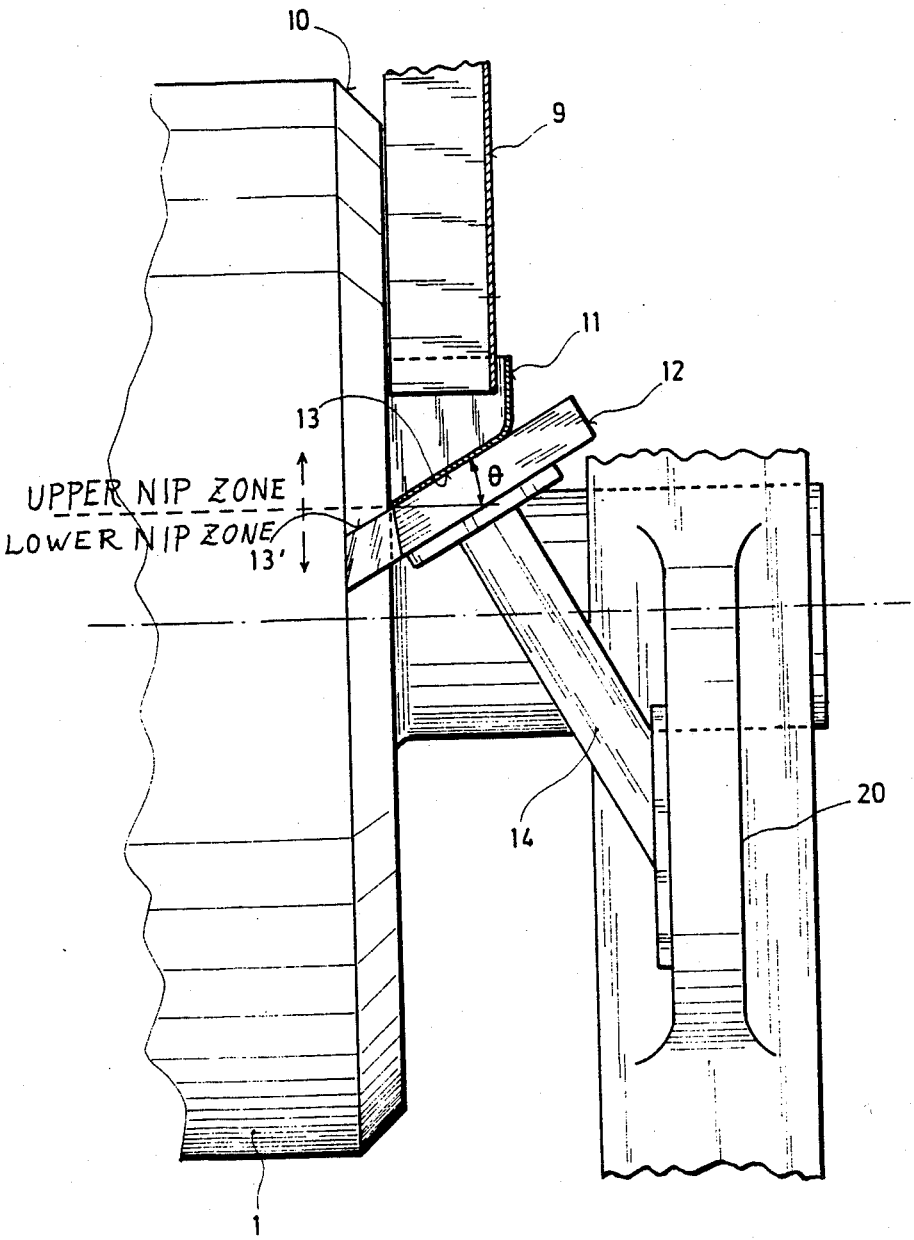
FIG. 2 shows a channel together with a collecting cup and a guide surface in a lateral view, partly in cross-section according to a preferred embodiment.
Figure 3:
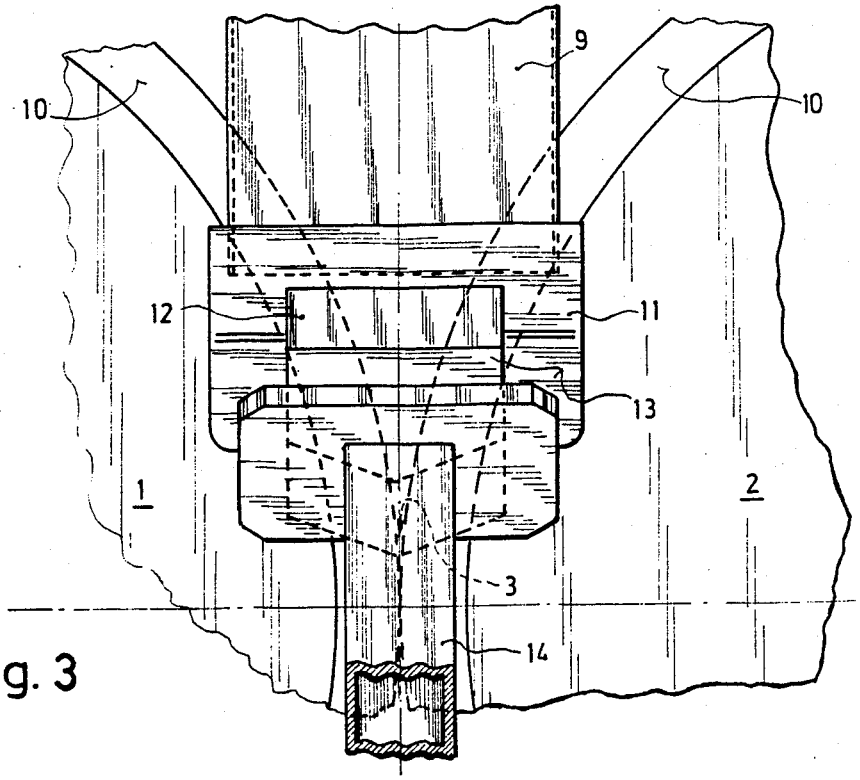
FIG. 3 represents the channel and guide according to FIG. 2 in a front view towards the rollers.
Figure 4:
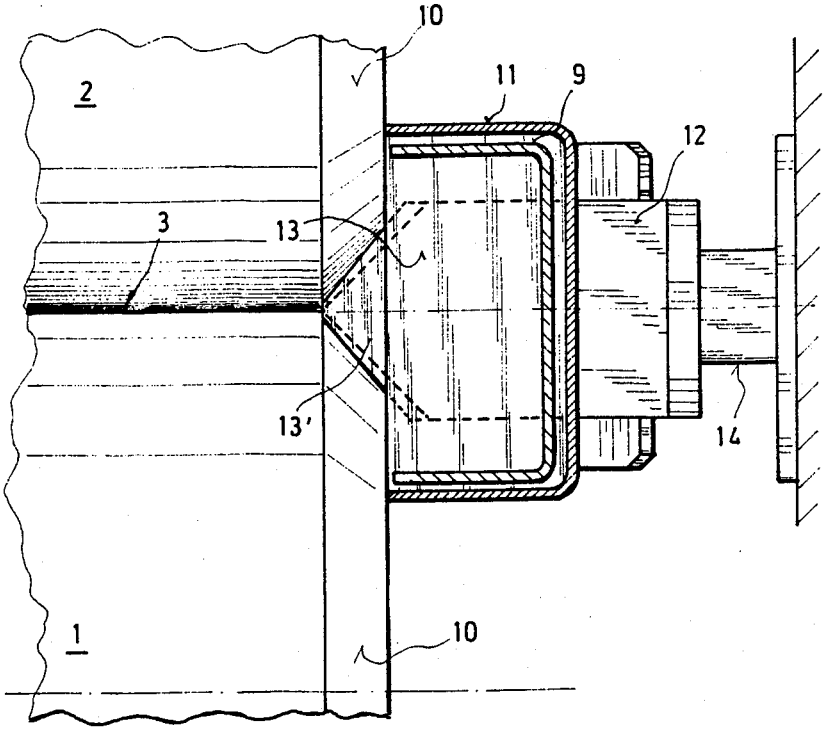
FIG. 4 depicts the channel and guide according to FIG. 2 in a plan view.

In the embodiment of FIGS. 2 to 4, the rollers 1, 2 have frusto-conical, tapered ends 10, the channels 9 discharging into a collecting cup 11 which rests upon a reinforcing plate 12. The collecting cup 11 comprises a guide surface 13 which preferably is inclined relative to a horizontal plane by an angle $\theta$. This angle suitably amounts to 20° to 60°, and in the embodiment shown about 30°. The reinforcing plate 12 is releasably mounted on a support 14 fixed to a bearing frame 20 of the roll mill. This reinforcing plate 12 comprises a tip 13' forming a continuation of the guide surface 13 and projecting between the tapered ends 10. To this end, the tip 13' is shaped to conform with the tapered ends 10. As may clearly be seen from FIG. 3, the guide surface 13 discharges above the nip 3 into the region between the two rollers 1 and 2. The roll mill will operate in such a manner that the particulate material to be milled is uniformly fed by the feed roll 8 into the nip 3, but that the supply of material is increased within the region of the ends of the rollers 1, 2, because the feed roll 8 feeds material beyond said ends, thus forming a certain product reserve within the channels and just in the end regions where usually the product has been fed less uniformly and to a smaller extent. To this end the channels 9 shall preferably have a certain minimum depth of at least 1 centimeter. A suitable range of depth is 2 to 8 centimeters, but in practice 5 to 6 centimeters will be optimum. This product reserve is then fed back above and into the nip 3, thus leading to the effect that the supply of material is made more uniform over the length of the rollers, whereby it may even be desirable to feed somewhat more material to the end zones in order to ensure that just there will not occur less wear than in the center regions.

Figure 5:
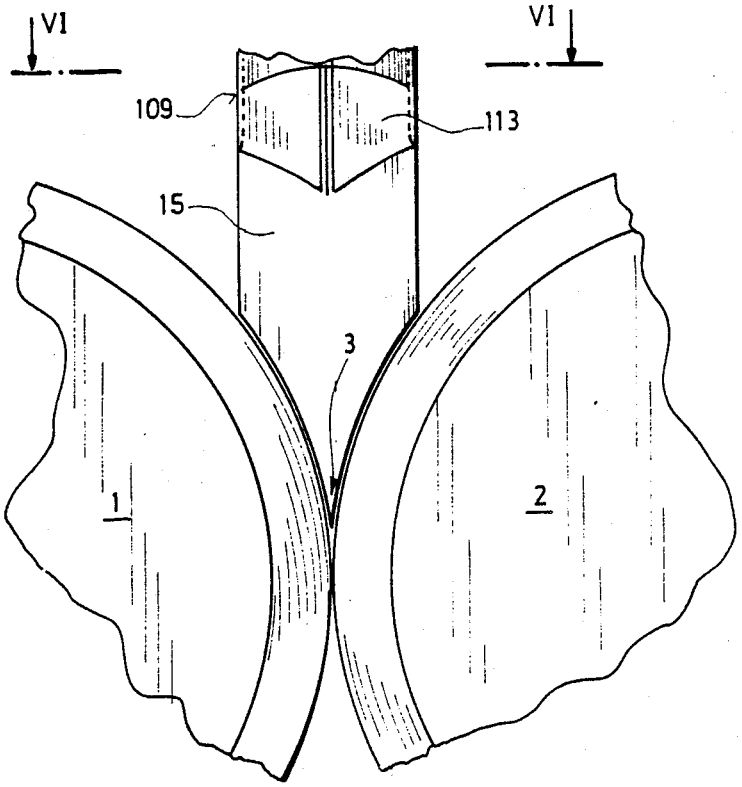
FIG. 5 is a lateral view of another embodiment using a wedge-like seal.
Figure 6:
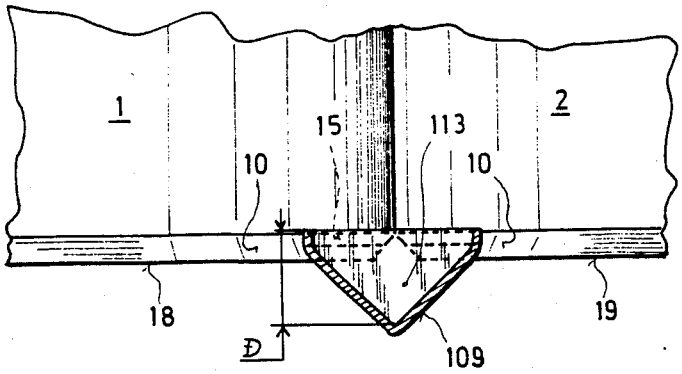
FIG. 6 the embodiment of FIG. 5 in a cross-sectional view along the line VI—VI of FIG. 5.

In the embodiment shown in FIGS. 5 and 6, there is a wedge plate 15, conforming to the outer cylindrical surfaces of the rollers 1, 2, and which—if desired—may cooperate with the tapered end portions 10 of the rollers 1 and 2. This wedge plate 15 has a guide surface 113 spaced from the nip 3 and being arranged at the end of a guide channel 109. As with the separated channels 9 and cup 11 of FIGS. 2 to 4, also in this case, it would be possible to form the wedge plate 15 as a part separated from the guide surface 113 in order to avoid the transfer of vibrations and/or to facilitate mounting and repair. The same numerals are used in all embodiments, but increased by 100 for parts of equivalent function in all embodiments.

As may be seen from FIG. 6, the channel 109 has a substantially triangular cross-section, one side of the triangle being substantially parallel to the front surfaces 18, 19 of the rollers 1, 2. It will be clear that it will be easily possible to prolong this channel 109 to the feed roll 8 or to mount a separate extension channel up to the feed roll 8 (see FIG. 1).

Figure 7:
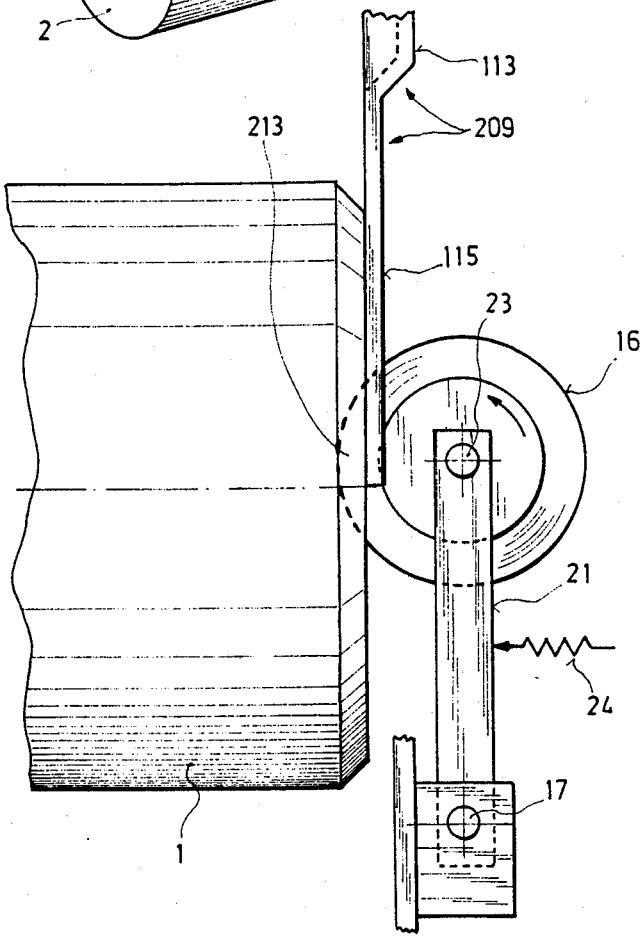
FIGS. 7 to 9 shows a further embodiment in respective views corresponding to FIGS. 2 to 4.
Figure 8:
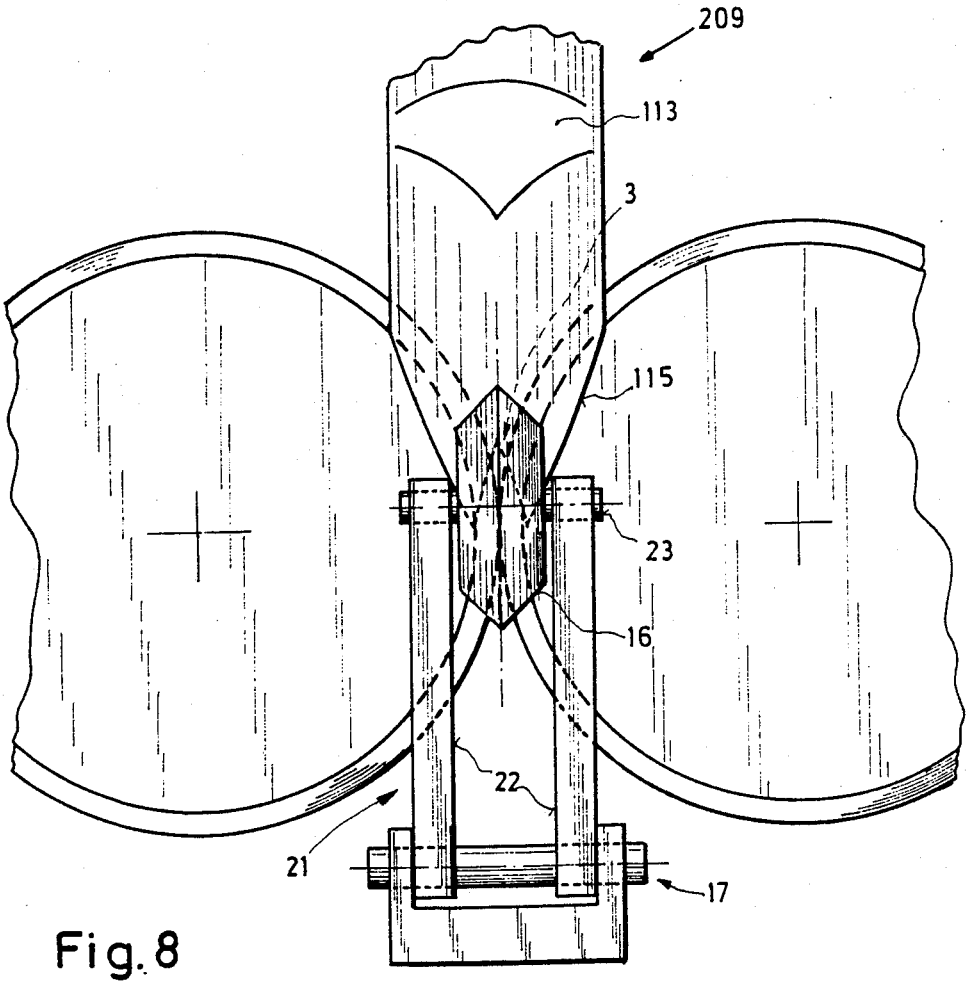
Figure 9:
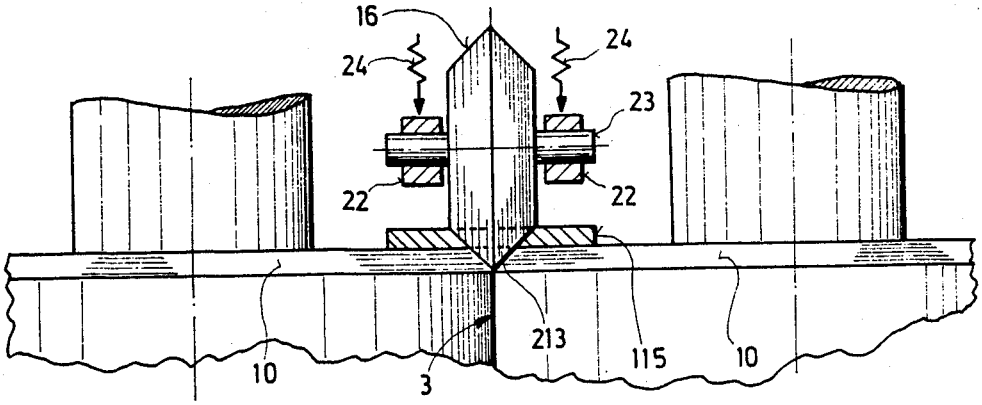

In the embodiment of FIGS. 7 to 9, instead of a stationary guide surface 13 or 113, as before, a movable one 213 in the form of a roller 16 is realized which has a peripheral surface being tapered in plan view (FIG. 9), as to conform to the tapered end portions 10 of the rollers 1, 2. Furthermore, a stationary (partial) guide surface 113 may also be provided at the lower portion of a channel 209.

The roller 16 is supported by a support lever 21 pivoted about an axis 17 and having, for example, two bifurcated arms 22 to bear an axis of rotation 23 for the roller 16. The lever 21 is urged against the rollers 1, 2 by a suitable biasing device (which e.g. may also be realized by pneumatic or hydraulic means) which, in the simplest case, is formed by a pressure spring 24 only schematically indicated. As an alternative, the support lever 21 may be formed itself by a leaf spring arrangement, fixed to the frame of the mill within the region where the pivot axis 17 is shown in the drawings. In such a case, the pivot axis 17 could be omitted.

As particularly shown in FIG. 8, the lateral guidance of the material may be effected within the region of the roller 16 (which frictionally engages the rollers 1, 2 and rotates in the direction of the arrow, shown in FIG. 7) by a wedge-shaped sealing plate 115 which not necessarily has to conform to the peripheral surfaces of the rollers 1, 2.

By using a movable, i.e. rotatable, guide surface 213 or roller 16, the particulate material is forcibly pressed into the nip 3 which fact may be of advantage for certain materials. In general, however, a stationary guide surface 13 or 113 will be more simple in design and easier in maintainance and, thus, preferred.

In a modified embodiment, it could be possible to provide an adjusting facility for the guide surface 13, 113 or 213 for an adjustment in height in order to adapt it to different particle sizes. It has already been mentioned that a particularly uniform distribution will be obtained, if the channels 9 or 109 have a maximum depth D (if depth is varying, e.g. in a triangular cross-section, see FIG. 6) in axial direction of the rollers 1, 2 of at least 1 centimeter, preferably of 2 to 8 centimeters, particularly 5 to 6 centimeters, this depth D being a main characteristic of the method according to the invention, since such a broad feeding width has been avoided up to now.

Figure 10:
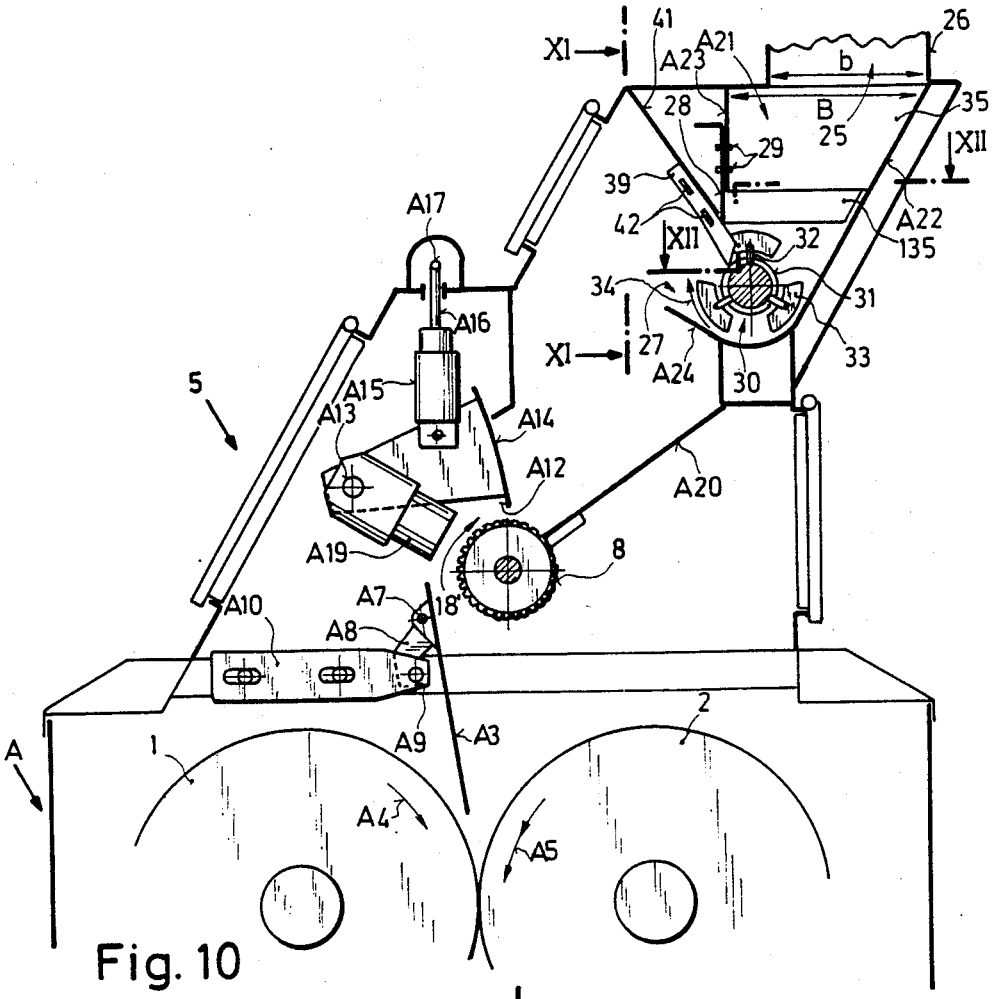
FIG. 10 illustrates a roll mill and box-type feeder, the formers in a lateral view, whilst the latter is in cross-section approximately along the line X—X of FIG. 11.

According to FIG. 10, the two rollers 1, 2 of the flaking mill are supported within a housing A and receive the particulate material through a feeder sheet A3. The rollers 1, 2 are pressed against each other in usual manner (not shown), as referred above, and are driven with slightly different speeds, as indicated by arrows A4 and A5.

The feeder sheet A3 is pivotally mounted about an axis A7 within the box-type feeder 5 (see also FIG. 1). This box-type feeder 5 rests upon the housing A. A lever A8 is connected to the feeder sheet A3, which acts upon a pin A9 fixed to a slider A10 that may be set into different positions.

Above the feeder sheet A3, the feed roll 8 is located opposed by a lower edge A12 of a proportioning sector A14 pivotal about an axis A13. A piston and cylinder unit A15 is hinged to the proportioning sector A14, the piston rod A16 of which being fixed to a mounting point A17 of the box-type feeder 5. Therefore, in accordance with the relative position of the piston rod A16, different positions of the edge A12 relatively to the feed roll 8, and, thus, a corresponding amount of material supplied will be obtained. To this end, the unit A15 (which may be a pneumatic or hydraulic one) could be controlled by an appropriate adjustment of the fluid supplied and/or automatically by measuring the current consumption of the drive for the rollers 1, 2 in order to maintain the current consumption at a constant level.

Although this feeding design is preferred, it would also be conceivable, to provide a second roller cooperating with the feed roll 8 to form the feed gap 18' instead of the sector A14 limiting this gap by its edge A12 together with the roll 8. Such additional roller had to be displaceable in order to adjust the width of the gap 18'. It will, however, be understood that the arrangement, as shown, is less expensive. Suitably in any case, a magnet A19 is provided following the feeding arrangement 8, A12–A17, 18' in order to separate iron parts eventually present within the material when passing this magnet A19. The material, which usually fills the entire space above the roll 8 and the sector A14, is guided to the feed roll 8 by an inclined hopper plate A20.

In accordance with the arrangement shown, there is a mixing compartment A21 above the hopper plate A20. This mixing compartment A21 is defined at its longer sides by a further hopper plate A22 of greater inclination than the plate A20, and by a vertical trough wall A23. At the bottom side, the compartment A21 is closed by a trough-like partition wall A24 which prevents the material, flowing through an inlet opening 25 and a feed tube 26 of rectangular cross-section connected thereto (see FIGS. 1, 2), from running directly to the outlet opening of the box-type feeder 5 formed by the gap 18' towards the rollers 1, 2. The only connection between the mixing compartment A21 and the feeding gap 18' is a relatively broad, slot-shaped interconnecting opening 27. This slot-shaped opening 27 may be adjusted, if desired, by displacing a slide wall 28 connected to the vertical trough wall A23 and by fixing the former in the respective position. Fixing of the slide wall 28 may be effected by clamping screws 29 in any position desired.

Within the mixing compartment A21, there is a mixer 30, suitably located within the range of the trough formed by the partition wall A24, said mixer 30 covering also the major part of the interconnecting opening 27, thus preventing that material, running through the inlet opening 25, from reaching the interconnecting opening 27 and from that into the feed gap 18' without being mixed. This mixer 30 comprises preferably a rotor 31 with freely ending mixer arms 32, having mixer blades 33 attached at the ends. The mixer blades 33 are suitably arranged along a helical path to form a mixing screw, as may be seen from FIGS. 11 and 12. It is favorable, if the the mixing screw has interrupted screw windings, as represented, in order to improve the mixing effect. Such interruptions of screw windings are provided either in radial direction between the rotor 31 and the blades 33, and in axial direction between the individual blades 33 mounted on an arm 32.

In this way, the effect will be obtained that the material, slowly flowing through the mixing compartment A21, is locally pressed aside by the blades 33, while the rotor 31 is rotating in the sense of arrow 34 (FIGS. 10, 11), whereupon the material from other places follows into the space cleared from material pressed away. Part of the material will remain undisplaced, due to the radial interruptions of the screw windings and will intermix itself with newly arriving material, while the material pressed away may turn aside in the axial interruptions and will intermix itself with following material. It should be mentioned that in this special case, there are other conditions than in most of the usual mixers for particulate material in which the same is whirled within a free space. To the contrary, as mentioned above, practically the whole box-type feeder 5, 6 is filled up with particulate material from the inlet opening 25 til the outlet opening or feeding gap 18', so that a whirl effect cannot come into play.

The fact that the mixing blades 33 are mounted on a respective arm 32, as is preferred, enables an adjustment of the mixing effect by turning the arms 32 about their longitudinal axes. Then, the arms will be fixed in their respective position by clamping screws (not shown) or by other means known per se. In this way, the inclination of the helical path of the blades 33 can be altered by simultaneously changing the width of the free interspaces between them.

Under the above-mentioned difficult conditions for the mixing operation, it is of some importance that the mixer 30 should not be subjected to the whole pressure of the material moving from above through the inlet opening 25, because otherwise the particles would agglomerate to such an extent under this pressure that the interruptions between the blades 33 of the mixer are insufficient to achieve the desired mixing effect, since the particles, thus agglomerated and adhering to each other by friction, would be also displaced within the interruptions by the blades. Since, however, friction depends also upon pressure, the mixing effect can be improved in that the mixing compartment A21 has a wider cross-section than the inlet opening 25. Such a widening of cross-section will result in axial direction of the rotor 31 (and parallelly to the longitudinal axes of the rollers 1, 2) in that the supply tube 26, being rectangular in cross-section, has a relatively small length 1 (FIG. 11) as compared with the greater length L of the mixing compartment A21 within the range of the mixing rotor 31. In this way, a relief will be achieved, particularly on the sides. In order not to lose this relief in that the material might again mass together within the mixing compartment A21 above the mixer 30, it is favorable to provide limiting walls 35 (FIG. 11) being in alignment with the inlet opening 25 and with the supply tube 26 and extending at its bottom side up to a certain level within the mixing compartment A21. Below these limiting walls 35, a sudden relief to the sides will result, favorizing the mixing effect of the mixer 30.

In order to obtain a pressure relief over the whole length of the mixer 30, also the width b of the supply tube 26, joining to the inlet opening 25, may be chosen smaller than the width B of the mixing compartment A21. That is also one reason why the angle of inclination of the hopper plate A22 is relatively precipitous, preferably of at least 60°, in order to avoid that the material might again be compressed towards the mixer 30. A certain setting facility may be reached by displacing the slide wall 28 which may comprise limiting walls 135, but it may be desirable under certain circumstances to have an adjusting facility to set the limiting walls 135 separately.

Figure 11:
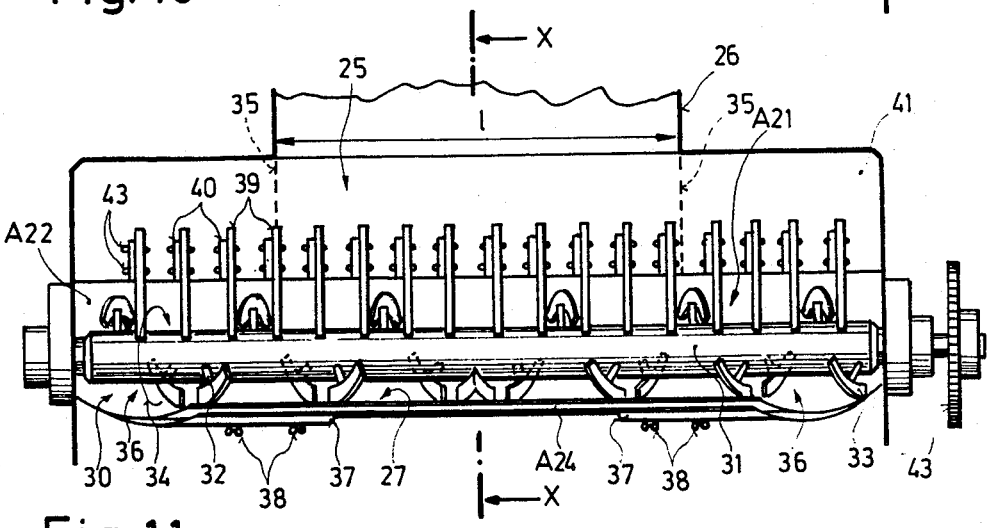
FIG. 11 is a cross-section along the line XI—XI of FIG. 10.
Figure 12:
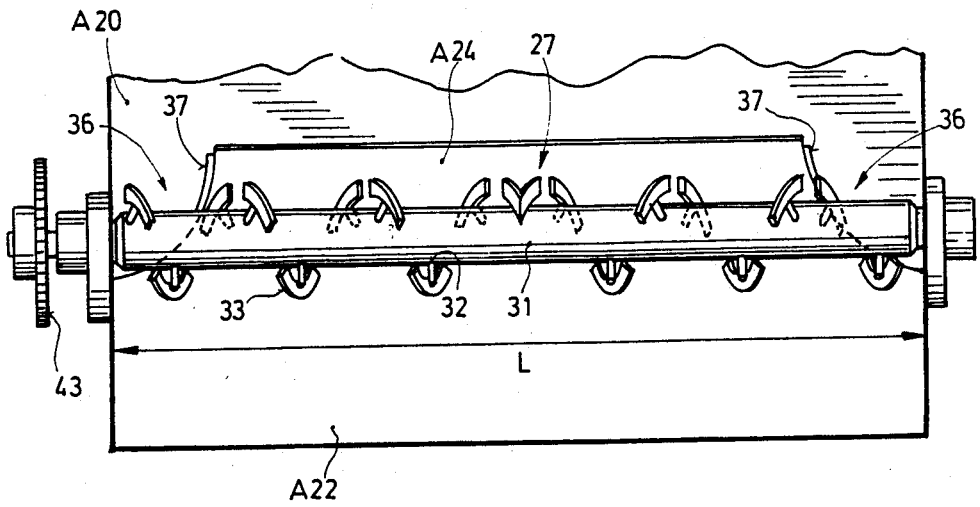
FIG. 12 is a cross-section along the line XII—XII of FIG. 10.

The enlargement in longitudinal direction of the mixing compartment A21, due to the differences in dimensions 1 and L, would, however, result in that less material were fed to the lateral ends towards the side of the front surfaces 18, 19 (see FIG. 6) of the rollers 1, 2, than to the center regions. Since, on the other hand, the lateral ends of the rollers 1, 2 are normally subjected to less wear than the center regions, it will even be desirable to supply more material to the lateral ends. These are reasons why it is favorable, if the mixer 30 has the arranged its paddles or blades 33 to form a helical screw path of opposing transporting directions, i.e. towards the exterior and to the lateral ends, as is depicted in FIGS. 11 and 12. Furthermore, another cummulative or alternative measure may consist in that the partition wall A24 has lateral recesses 36, as best seen in FIG. 12. The dimensions of such recesses 36' might be adjustable by means of sliders 37 (FIG. 11) which may be fixed in any position desired by fixing screws 38. It would also be conceivable to provide the partition wall A24 with lateral break throughs or apertures rather than with bow-shaped recesses 36. In any case, the recesses 36 (or the apertures) form enlargements of the lateral regions of the opening 27 interconnecting the mixing compartment A21 and the outlet or feeding opening 18'.

As already mentioned, the supply of particulate material may be effected from a bin and/or via a conveyor, particularly through the chain conveyor 6 (FIG. 1). In the course of transport, it is possible that agglomerates are formed under some influences (such as pressure, moisture and so on), such agglomerates being detrimental for mixing operation by mixer 30, but also for feeding over the feed roll 8 and through the gap 18'. This will apply independently upon whether feeding is effected through the feed roll 8, as shown, or through a vibrating conveyor (which constitutes an alternative possibilty) with the sector A14 facing a vibrating plate. Such agglomerates would be the more disadvantageous, if no further feeder would be provided below the mixing compartment A21, as has already been proposed. Although the operation of the mixer provokes in part a dissolving action, but it is more favorable to arrange additional dissolving means.

Such dissolving means are formed, according to FIGS. 10 and 11, by blade-like stator tools 39 mounted on extensions 40 (FIG. 11) of an inclined wal 41 by means of longholes 42 (FIG. 10) in said blades 39 into which clamping bolts are inserted for adjustment. If it is desired to adjust the inclination of the mixing blades or paddles 33 by turning the arms 32, it is suitable, if the stator tools 39 can be fixed in any position desired on a clamping bar (or a plurality of shorter bars) extending across the inclined wall 41 and normally to the blade-like stator tools 39. If necessary, it would also be possible to arrange two blade tools 39 between each pair of paddles 33.

As may be seen, the blade tools 39 extend shortly beneath the circumferential surface of the rotor 31 and are inserted between two respective paddles 33 (see FIG. 11), having such a small distance from the side edges of the blades 33 that they are enabled to cooperate with these edges in the sense of a dissolving action.

Figure 13:
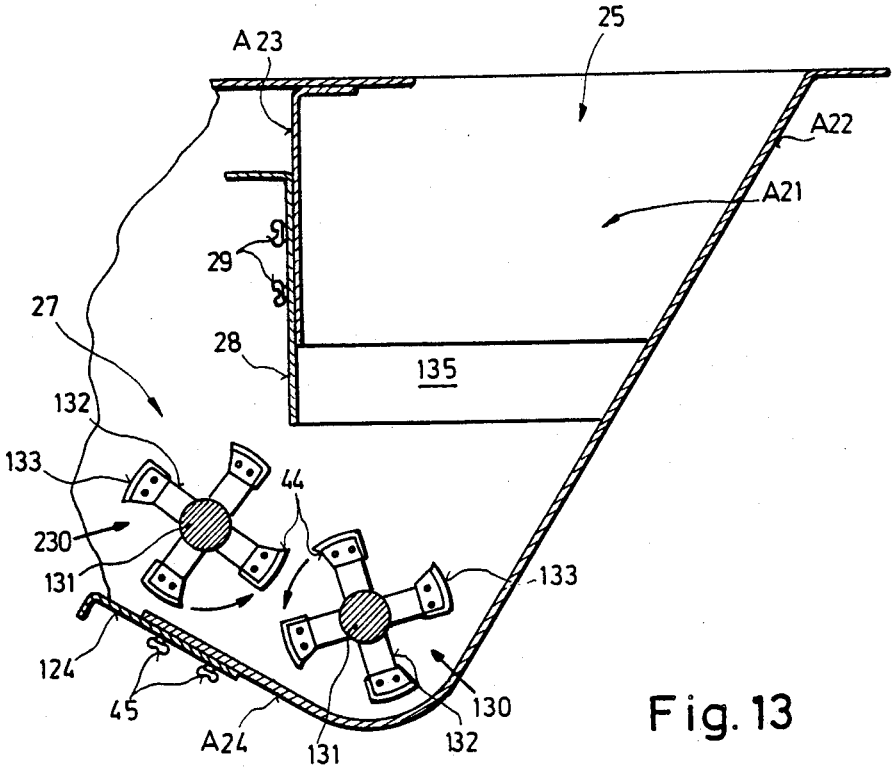
FIG. 13 is a modification of a detail of FIG. 10 on a larger scale.

An alternative arrangement will be described later with reference to FIG. 13.

Motion can be imparted to the mixer 30 either by a common drive for it together with the rollers 1, 2 and/or for the feed roll 8. To this end, a drive wheel 43 may be provided (FIGS. 11, 12). If desired, however, a separate motor may be provided for the mixer 30.

While the stator tools or blades 39 will act more in axial direction by the side edges of the paddles 33 for dissolving material, this may also be achieved by a cooperation of the mixer 30 and of its arms 32 and blades 33 together with counterarms which are off-set in radial direction, as will now be described with reference to FIG. 13. It should be noted, however, that it is possible, of course, to provide stator tools 39 also in an embodiment according to FIG. 13, and, if desired, for each of the two mixers 130, 230 shown in FIG. 13.

In contrast to the embodiment of FIG. 10, two identical rotors 131 are provided, bearing paddles 133 on arms 132. As indicated by arrows of rotation sense, the direction of rotation of the two rotors is opposite each other, and it is possible, if necessary, to rotate the rotors with different speeds. For example, the rotor 131 of the mixer 130 may rotate with a higher speed than that of the mixer 230. The reason is that the mixer 230 is situated between the mixer 130 and the interconnecting opening 27 and acts, to some extent, as a shielding member. For other mixer designs, it may be suitable to drive the rotors in the same direction, but the dissolving effect will normally be better with an opposite sense of rotation. It will aslo be understood that also in this embodiment, the arms 132 may be pivotably mounted about their longitudinal axes.

The arms 132 provided with paddles 133 of the mixer 230 cooperate with those of the mixer 130, instead of with stator tools 39 in the embodiment described above. It may be favorable to equip the front edges 44 of the paddles 133, which face each other, with noses, in some cases formed as short bars extending parallely to the longitudinal axes of the rotors 131. In this way, agglomerates will be dissolved between the two rotors 131. Moreover, a better mixing effect will be obtained, although it has been found that a single rotor 30 (FIG. 10) will be sufficient for most applications and is also simpler in design. It should be noted that the two mixers 130, 230, in the case of arranging their blades in alignment with a helical path, should have the same conveying direction (and particularly opposite conveying directions with respect to the longitudinal axis of the supply tube 26, as shown in in FIG. 11), but it would also be possible to provide short sections of an opposite direction of transportation on one rotor, particularly on the rotor of mixer 230 with respect to mixer 130, in order to improve the mixing effect.

It has already been described above that the dimension of the interconnecting opening 27 may be adjusted by displacing the slide wall 28. In the embodiment according to FIG. 13, there is an additional adjusting facility influencing, above all, the period of dwell of the material within the region of the mixer 230 and, thus, the degree of intermixing particles. The question is of a slidable extension wall 124 of the partition A24 which can be fixed in different position by clamping screws 45.

Numerous modifications are possible within the scope of the invention; for example, it has been mentioned above that the mixing action of the preferably used paddle screws is not based on a whirling effect, as in mostof the mixers for particulate material, due to the fact that the mixing compartment is completely filled up. The action of the paddle screws shown may rather be compared with those for mixing plastic material. Nevertheless, the invention is by no means restricted to the use of a mixer or to a special type of mixer. For example, it would be conceivable to arrange an additional feeder at the inlet opening 25 relieving practically in this way the mixing compartment from supply duties and, thus, from pressure of the material to be treated, so that also whirling mixer of known design could be used, e.g. also with a pneumatic whirling action. Furthermore, mixer arms moving to and fro could be provided instead of a rotating mixer. It will, however, be understood that the last-mentioned mixer arms will have less efficiency and that an additional feeder within the range of the inlet opening 25 would mean additional costs.

Moreover, it may be suitable in the case of very large rollers 1, 2 to subdivide the interconnecting opening 27 in order to avoid that the freely suspended partition wall A24 might be subjected to vibrations; in this case, a plurality of interconnceting openings would be applied. Furthermore, it is clear that it is not necessary to provide a feeding opening 18' of variable width, since it is also possible to effect controlled proportioning by controlling the rotational speed of the feed roll 8.

What is claimed is:

1. A roll mill comprising a pair of rollers having a predetermined axial length between lateral end surfaces, and generally cylindrical outer surfaces forming a roll nip to grip particles within a predetermined range of sizes to be milled between said outer surfaces in an upper zone of the nip and for squeezing the particles below said upper zone in an intermediate nip zone, when the rollers rotate about respective axes of rotation of the rollers;

feeding means for feeding said particles to be milled to said rollers over a feeding width exceeding the axial length of said rollers;

channel means having a first end adjacent said feeding means and a second end adjacent the lateral ends of said rollers for limiting said feeding width and for guiding particles fed at the lateral ends of said feeding width towards the end surfaces of the rollers;

guide means for guiding the particles fed through said channel means to said rollers at a location above said nip, the guide means extending from said second end of the channel means to a level above said upper zone of the nip to inhibit entry of the particles from said channel means below said level into a side of the nip; and wherein said guide means comprise a guide surface inclined relative to a horizontal plane by a predetermined angle from the second end of the channel means downwards towards said level; and said rollers comprise frusto-conical end portions, and said guide means comprise a wedge structure extending between said frusto-conical end portions of the rollers.

2. A roll mill according to claim 1, wherein said channel means are disposed vertically and adjacent the lateral end surfaces of rollers.

3. A roll mill as claimed in claim 1, wherein said predetermined angle amounts to 20° to 60°.

4. A roll mill as claimed in claim 3, wherein said predetermined angle is in the range of 30°.

5. A roll mill as claimed in claim 1, wherein said guide means are stationary.

6. A roll mill as claimed in claim 1, wherein said guide means are slightly spaced from said channel means.

7. A roll mill as claimed in claim 1, wherein said guide means comprise lateral wall means to form a cup-like structure together with a bottom guide surface, the cup-like structure merely being laterally open towards said nip.

8. A roll mill as claimed in claim 1, said guide means comprise a guide wall and a reinforcing plate bearing said guide wall.

9. A roll mill as claimed in claim 1, wherein said wedge portion is shaped as to conform to said frusto-conical end portions of the rollers.

10. A roll mill as claimed in claim 1, wherein said channel means are open towards said rollers.

11. A roll mill as claimed in claim 1, wherein said channel means have a predetermined width in axial direction of said rollers of at least 1 centimeter.

12. A roll mill as claimed in claim 11, wherein said predetermined width amounts to 2 to 8 centimeters.

13. A roll mill as claimed in claim 12, wherein said predetermined width amounts to 5 to 6 centimeters.

14. A roll mill as claimed in claim 1, wherein the roll mill is a flaking mill and the rollers are flaking rollers, and wherein said feeding means comprise a box-type feeder including wall means enclosing a mixing compartment to receive said particles to be milled and defining an inlet opening for the particles, means defining a feeder outlet opening towards said rollers, and mixing means movable within said mixing compartment and comprising freely ending mixing arms.

15. A roll mill as claimed in claim 14, wherein the free ends of said at least a greater proportion of said arms are free of end connections with each other.

16. A roll mill as claimed in claim 15, wherein all ends are free of end connections with each other.

17. A roll mill as claimed in claim 15, wherein said free ends comprise widened end surfaces.

18. A roll mill as claimed in claim 14, wherein said wall means comprise a partition wall shielding the mixing compartment against said feeder outlet opening to prevent the particles from free access to the feeder outlet opening, said partition wall leaving a restricted interconnecting opening.

19. A roll mill as claimed in claim 18, wherein said mixing means are arranged in immediate vicinity of said partition wall.

20. A roll mill as claimed in claim 19, wherein said mixing means are arranged just before said interconnecting opening, when seen in feeding direction of the particles.

21. A roll mill as claimed in claim 18, wherein said interconnecting opening extends at least over the major part of the length of said rollers.

22. A roll mill as claimed in claim 21, wherein said interconnecting opening has substantially the same length as the rollers.

23. A roll mill as claimed in claim 21, wherein said interconnecting opening has a greater cross-sectional area at the lateral sides than in its middle.

24. A roll mill as claimed in claim 23, wherein said partition wall has recesses on its lateral sides to increase the cross-sectional area of the interconnecting opening.

25. A roll mill as claimed in claim 18, further comprising setting means for adjusting the cross-sectional area of said interconnecting opening.

26. A roll mill as claimed in claim 21, wherein said wall means comprise a substantially vertically extending trough wall, said partition wall is in one piece fixed to said trough wall to extend in the bottom range of said mixing compartment, and said interconnecting opening is opposite said trough wall.

27. A roll mill as claimed in claim 14, wherein said mixing means comprise a mixer rotor arranged in parallel relationship to said rollers.

28. A roll mill as claimed in claim 27, wherein said wall means comprise a partition wall shielding the mixing compartment against said feeder outlet opening to prevent the particles from free access to the feeder outlet opening, said partition wall being bent around said mixer rotor, thereby leaving a restricted interconnecting opening.

29. A roll mill as claimed in claim 27, wherein said mixing rotor has the freely ending arms arranged about its periphery, the free ends bearing paddle-like extensions arranged along a helical path.

30. A roll mill as claimed in claim 14, wherein said mixing compartment, after the inlet opening, is widened to a larger cross-sectional area than that of the inlet opening.

31. A roll mill as claimed in claim 30, wherein the widened cross-sectional area is due to at least a widened dimension parallel to the axes of rotation of said rollers.

32. A roll mill as claimed in claim 31, wherein said mixing means comprise a mixer rotor arranged in parallel relationship to said rollers, said mixing rotor having the freely ending arms arranged about its periphery, the free ends bearing paddle-like extensions arranged along a helical path, the helical path being to feed the particles in opposite directions from a center region while simultaneously mixing.

33. A roll mill as claimed in claim 30, wherein said wall means comprise at least a pair of limiting walls protruding into said mixing compartment and being in alignment with said inlet opening to ensure a uniform distribution of said particles.

34. A roll mill as claimed in claim 14, further comprising counter-arms extending at least in part in counter direction against said freely ending arms for dissolving agglomerates of said particles.

35. A roll mill as claimed in claim 34, wherein said mixing means comprise a mixer rotor and said counter-arms are rotatably mounted about an axis parallel to said mixing rotor.

36. A roll mill as claimed in claim 34, wherein said counterarms are stationary stator arms intermeshing with said freely ending arms.

37. A roll mill as claimed in claim 36, further comprising adjusting means for adjusting the position of said counter-arms relatively to said freely ending arms.

38. A roll mill as claimed in claim 14, wherein said feeding means further comprise rotary feeder means for the dosed supply of said particles to said rollers, said mixing compartment being arranged before said rotary feeder means.

39. A method for feeding particulate material within a predetermined range of sizes to a roll mill which comprises a pair of rollers of predetermined axial length, having generally cylindrical outer surfaces forming a roll nip to grip said particulate material between said surfaces in an upper zone of the nip and for squeezing the particles below said upper zone in an intermediate nip zone, the method comprising the steps of feeding said particulate material in a width greater than said axial length by at least one centimeter;

collecting the particulate material fed beyond the axial length;

guiding all the collected particulate material to a level above said upper zone of the nip and discharging it thereinto the nip; and wherein said step of guiding includes a step of inhibiting a discharge of particles below said level for improved wearability of said rollers.

40. A roll mill comprising:

a pair of rotatable rollers axially parallel to each other having a predetermined axial length between lateral end surfaces thereof, the rollers having substantially cylindrical outer surfaces forming therebetween a roll nip to grip particles within a predetermined range of sizes to be milled between said outer surfaces in an upper zone of the nip and for squeezing the particles below said upper zone in an intermediate nip zone when the rollers rotate about respective axes of rotation;

feeding means for feeding said particles above a predetermined level to said rollers over a feeding width exceeding the axial length of said rollers; and guide means for limiting said feeding width, said guide means receiving said particles from said feeding means adjacent lateral ends of said feeding width and guiding and discharging all of the particles so received to above said upper zone of the nip adjacent said lateral ends of the rollers; and wherein said rollers comprise frusto-conical end portions, and said guide means comprise a wedge structure extending between said frusto-conical end portions of the rollers to inhibit discharge of particles below said predetermined level.

41. A roll mill comprising:

a pair of rollers having a predetermined axial length between lateral end surfaces, and generally cylindrical outer surfaces forming a roll nip to grip particles within a predetermined range of sizes to be milled between said outer surfaces in an upper zone of the nip and for squeezing the particles below said upper zone in an intermediate nip zone, when the rollers rotate about respective axes of rotation of the rollers;

feeding means for feeding said particles to be milled to said rollers over a feeding width exceeding the axial length of said rollers;

channel means having a first end adjacent said feeding means and a second end adjacent the lateral ends of said rollers for limiting said feeding width and for guiding particles fed at the lateral lends of said feeding width towards the end surfaces of the rollers;

guide means for the particles fed through said channel means, the guide means extending from said second end of the channel means to a level above said upper zone of the nip for discharging all the particles from said channel means above said upper zone of the nip; and wherein said rollers comprise frusto-conical end portions, and said guide means comprise a wedge structure extending between said frusto-conical end portions of the rollers to inhibit entry of the particles from said channel means into a side of the nip below said level.

42. A roll mill comprising a pair of rollers having a predetermined axial length between lateral end surfaces, and generally cylindrical outer surfaces forming a roll nip to grip particles within a predetermined range of sizes to be milled between said outer surfaces in an upper zone of the nip and for squeezing the particles below said upper zone in an intermediate nip zone, when the rollers rotate about respective axes of rotation of the rollers;

feeding means for feeding said particles to be milled to said rollers over a feeding width exceeding the axial length of said rollers;

channel means having a first end adjacent said feeding means and a second end adjacent the lateral ends of said rollers for limiting said feeding width and for guiding particles fed at the lateral ends of said feeding width towards the end surfaces of the rollers; and guide means for guiding the particles fed through said channel means to said rollers at a location above said nip, the guide means extending from said second end of the channel means to a level above said upper zone of the nip to prevent entry of the particles from said channel means below said level into a side of the nip, the guide means discharging all the particles from said channel means above said upper zone of the nip.

* * * * *